US010169947B1

(12) United States Patent
Sumner

(10) Patent No.: US 10,169,947 B1
(45) Date of Patent: Jan. 1, 2019

(54) TRANSACTION DEVICE AND A METHOD OF CURRENCY ITEM REPLENISHMENT IN A TRANSACTION DEVICE

(71) Applicant: Innovative Technology Limited, Oldham (GB)

(72) Inventor: Dylan Sumner, Oldham (GB)

(73) Assignee: Innovative Technology Limited, Oldham (GB)

( * ) Notice: Subject to any disclaimer, the term of this patent is extended or adjusted under 35 U.S.C. 154(b) by 0 days.

(21) Appl. No.: 15/728,825

(22) Filed: Oct. 10, 2017

(51) Int. Cl.
*G07D 11/00* (2006.01)
*G07F 19/00* (2006.01)

(52) U.S. Cl.
CPC ..... *G07D 11/0057* (2013.01); *G07F 19/20* (2013.01)

(58) Field of Classification Search
CPC ..... G06F 17/60; G06Q 10/087
USPC ..... 235/379
See application file for complete search history.

(56) References Cited

U.S. PATENT DOCUMENTS

| | | | | |
|---|---|---|---|---|
| 8,300,916 | B2 | 10/2012 | Strong et al. | |
| 8,376,116 | B2 | 2/2013 | Robinson et al. | |
| 8,448,773 | B2 | 5/2013 | Dunlop et al. | |
| 8,668,559 | B2 | 3/2014 | Bellis | |
| 9,053,597 | B1 | 6/2015 | Sackfield et al. | |
| 9,171,414 | B2 | 10/2015 | Sackfield | |
| 9,189,906 | B2 | 11/2015 | Sackfield | |
| 9,355,513 | B2 | 5/2016 | Robinson | |
| 9,466,166 | B2 | 10/2016 | Robinson | |
| 9,483,893 | B2 | 11/2016 | Bullock et al. | |
| 2002/0120572 | A1* | 8/2002 | Bellucci | G06Q 20/06 705/43 |
| 2007/0182090 | A1* | 8/2007 | Gerlier | B65H 29/145 271/180 |
| 2015/0178670 | A1* | 6/2015 | Angus | G06Q 10/087 705/28 |

* cited by examiner

*Primary Examiner* — Daniel A Hess
(74) *Attorney, Agent, or Firm* — Woodard, Emhardt, Moriarty, McNett & Henry LLP

(57) ABSTRACT

A method and device for managing currency item replenishment in a transaction device configured to accept a plurality m of currency item denominations, wherein the method comprises analyzing transaction history data to produce statistics from which an optimum currency item replenishment period and currency item replenishment levels are determined.

15 Claims, 4 Drawing Sheets

TRANSACTION DEVICE AND A METHOD OF CURRENCY ITEM REPLENISHMENT IN A TRANSACTION DEVICE

The present invention generally relates to the management of cash levels in machines configured to accept currency items in exchange for goods and/or services. In particular, the present invention relates to a method of managing currency item replenishment in a transaction device adapted to receive coins or banknotes or a combination of the two.

Although the invention will be described in the context of coin handling, this is only for convenience, and it should be understood that the present invention is equally applicable to the handling of other items of currency, such as banknotes for example.

Conventionally, vending machines and gaming machines, or other similar transaction machines or coin-freed apparatus, include a currency item acceptor/dispenser and a cashbox. Typically, the cashbox will be periodically emptied and replenished with a predetermined quantity of currency items in the form of a cash 'float'. A cash float will comprise a given number of each of the currency denominations that is accepted by the transaction machine, and the levels for each denomination are usually calculated to ensure an adequate supply of currency items (banknotes and coins) for dispensing as change to a user of the machine when required.

A problem exists in that the periodic emptying of transaction machine cashboxes and the refilling of them with a predetermined float level of currency items is time consuming and inefficient. Furthermore, it is difficult to strike a balance between maintaining float levels that are adequate for continuous transaction machine functioning whilst avoiding a situation in which large volumes of cash are being unnecessarily stored within the transaction machine. Also, different transaction machines often require differing float levels. For instance, a gaming machine will typically have a much larger cash float than, say, a vending machine, since gaming machines need to retain sufficient amounts of currency items in order to meet the demands of jackpot and prize win payouts.

A further problem arises in relation to the geographic location of transaction machines. Transaction machines in some locations may experience much greater use than machines in other areas leading to the need for a higher frequency of collection and replenishment operations.

The present invention seeks to address the aforementioned problems that are associated with the prior art.

According to an aspect of the present invention there is provided a method of managing currency item replenishment in a transaction device configured to accept a plurality m of currency item denominations, wherein the method comprises analysing transaction history data to produce at least one statistical distribution from which an optimum currency item replenishment period and currency item replenishment levels are determined.

Preferably, the method comprises: monitoring a plurality of monetary transactions executed by said transaction apparatus; determine for each of the plurality of currency item denominations a net payout per transaction distribution over the plurality of monetary transactions; determine a probability density function for currency exhaustion after n transactions for each of the m currency item denominations; determine a global probability density function for currency exhaustion of at least one of the plurality of currency item denominations after n transactions based on the m probability density functions; iteratively adjust the probability density function for each of the m currency item denominations by exchanging currency item quantity allocation q between the m currency item denominations until the number of transactions N at which the global probability density function equals a predetermined probability T converges to a stationary value; and use the stationary value of N to calculate the optimum currency item replenishment period and set q for which N is stationary to be the optimum currency item replenishment level.

The optimum currency item replenishment level q comprises a set of currency item quantity allocations, and for i=1 to m, $q=q_1+q_2+\ldots+q_m$. That is to say, q is the total number of currency items, coins for example, that are required for a given replenishment operation.

The optimum currency item replenishment period can be calculated using the average time elapsed between each of the n transactions.

Preferably, transaction history data is monitored and collected locally by the transaction apparatus. Alternatively, transaction history data is monitored and collected by a remote processing means via a wired or a wireless network connection.

Preferably, the transaction control means is configured to record transaction history data and includes a statistics module. Alternatively, or in addition, the remote processing means includes a statistics module.

The transaction device is configured to accept and process coins and/or banknotes.

According to another aspect of the present invention there is provided a transaction device configured to accept a plurality m of currency item denominations, wherein said transaction device comprises: a currency item validator unit including a currency item input/output; a currency item storage means; a currency item transport mechanism interconnecting the currency item validator unit and the currency item storage means; and transaction control means connected to the currency item validator unit and the currency item storage means; wherein the transaction control means is configured to record transaction history data.

Preferably, the transaction control means includes a statistics module configured to execute statistical analysis of transaction history data.

Preferably, the transaction device includes a wired or wireless network interface configured to communicate with a remote processing means.

The transaction device is configured to accept and process coins and/or banknotes.

Advantageously, the transaction control means is configured to execute the method as claimed in any of claims 1 to 6.

Advantageously, the remote processing means is configured to execute the method as claimed in any of claims 1 to 6.

An embodiment of the present invention will now be described, by way of example only, with reference to the accompanying drawings, in which.

Figure 1:
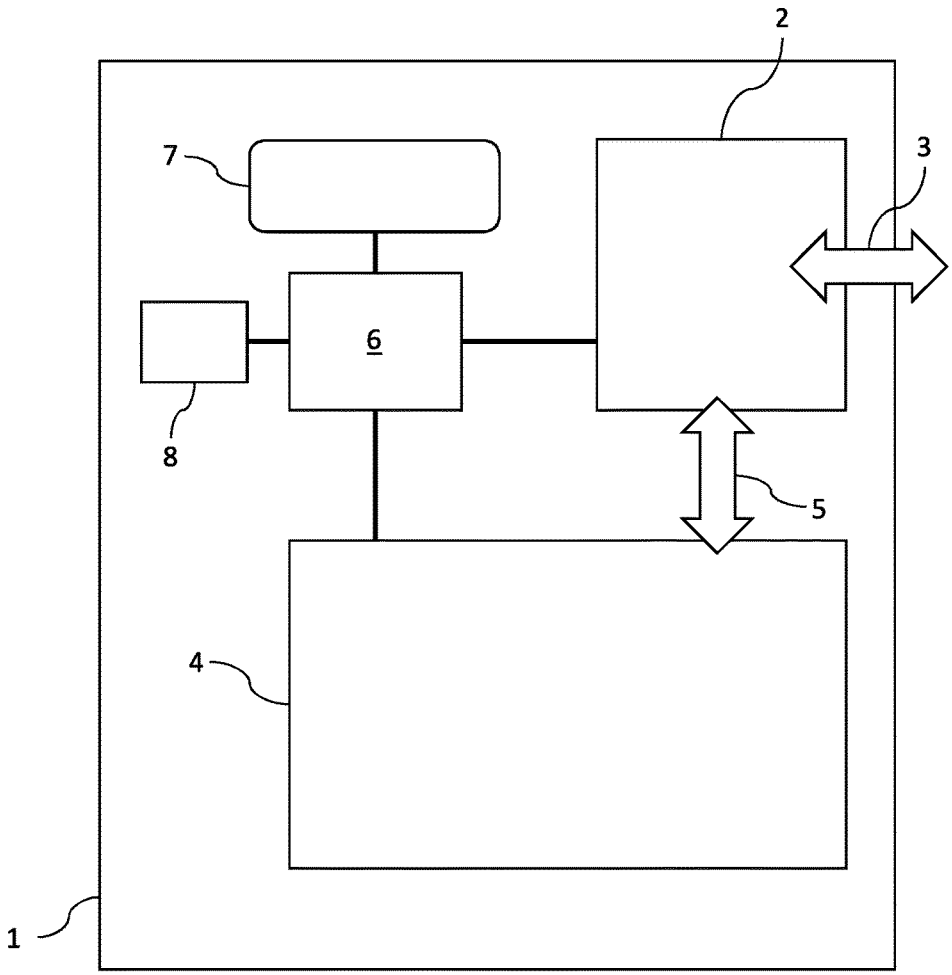
FIG. 1 shows an embodiment of a transaction device according to the present invention.

As shown in FIG. 1, a transaction device 1 of the present invention comprises a currency item validator unit 2 and a currency item storage means 4.

The currency item validator unit 2 may be a conventional coin validator/acceptor, a conventional banknote validator/acceptor, or a combination unit configured to validate both coins and banknotes. The currency item validator unit 2 includes a currency input/output 3 enabling the transaction device 1 to receive and dispense currency items.

The currency item validator unit 2 is interconnected with the currency item storage means 4 via a currency transport mechanism 5 which is adapted to transport currency items to and from the currency item storage means 4 in any of the known conventional ways.

The transaction device 1 includes a transaction control means 6 which is configured to monitor the input of currency items and record the number of each denomination of currency items that is dispensed during any given period of transaction operations. The transaction control means 6 may be a microprocessor or other such suitable processing unit connected to both the currency item validator unit 2 and the currency item storage means 4.

Advantageously, the transaction control means 6 incorporates a statistics module (not shown) for implementing statistical analysis of transaction data and executing associated statistical algorithms.

A display unit 7 is provided to enable an operative attending the transaction device 1 to obtain transaction data from the transaction control means 6.

The transaction device 1 incorporates a network connection 8 to enable transaction data to a be accessed from a remote location. The network connection may be an interface for a wired or wireless network. Preferably, the network connection 8 enables remote interrogation of the transaction device 1 via the Internet. However, it should be understood that other networks can be utilised such as mobile telephone networks or an ultra-narrowband low power wide area network, for example.

The currency item storage means 4 may take the form of a multi-denomination coin hopper as are well known in the art. Alternatively, or in combination, the storage means 6 may be one or more banknote storage drums or stacker units. Such banknote storage devices are also well known in the art.

In operation, the transaction device 1 is configured to accept and process m denominations of currency items (banknotes or coins). In the example discussed below m=8. Here, the transaction device was configured to accept coins only and the denominations acceptable were: €0.01, €0.02, €0.05, €0.1, €0.2, €0.5, €1, and €2. However, it should be noted that any number of denominations may be used in the method according to the present invention.

In a given transaction device 1 the initial quantity of coins stored in the currency item storage means 6 is defined as Q, where $Q=[q_1, q_2, \ldots, q_m]$ and $q_m$ is the number of coins stored for the mth denomination. The task is therefore to determine an optimal level for Q in order that over a given transaction period, which may be a number of days, weeks or months, the probability of coin starvation for any denomination is minimised or kept within a predetermined risk level T [see below].

Firstly, it is necessary to make predictions as to when each denomination will run out, and this is done by recording and analysing the transaction history of a particular transaction device and using this information to extrapolate probabilities of coin starvation events. In a preferred embodiment the transaction history data is recorded and compiled by the transaction control means 6. This data is then analysed to produce histograms of the net payout per transaction for each of the m denominations.

Figure 2:
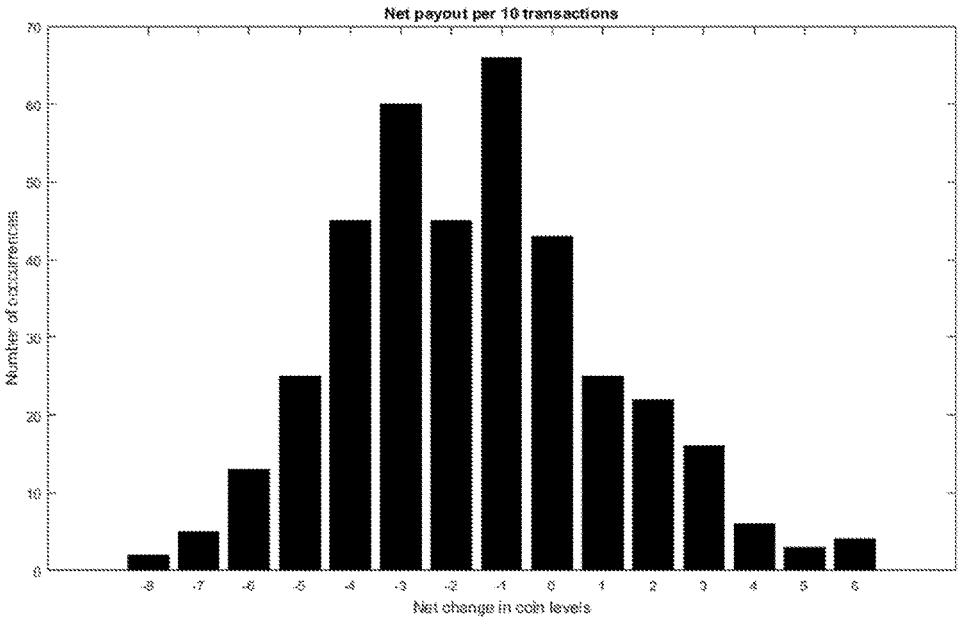
FIG. 2 shows a transaction histogram.

An example histogram is shown in FIG. 2, and the distribution illustrates the net change in coin levels per 10 transactions. A transaction is defined as any coin input or output event at a given transaction device.

From normalised histogram data a probability density function (PDF) for each of the m denominations can be determined from the mean (μ) and standard deviation (σ) of the collated transaction data.

If data is obtained for the net coin change per n transactions, then the central limit theorem predicts that as n approaches infinity the PDF tends to an approximation of a normal distribution. Consequently, for any given n transactions probability density function parameters can be defined as:

$$\mu_n = n\mu \tag{1}$$

$$\sigma_n^2 = n\sigma^2 \tag{2}$$

From equations (1) and (2) a probability density function can be defined by:

$$f(x) = \frac{1}{\sigma\sqrt{2\pi n}} e^{-\frac{(x-n\mu)^2}{(2n^2\sigma^2)}} \tag{3}$$

where x is the net change in coin numbers per transactions. From equation (3) it is possible to construct a family of probability distributions as shown in FIG. 3.

Figure 3:
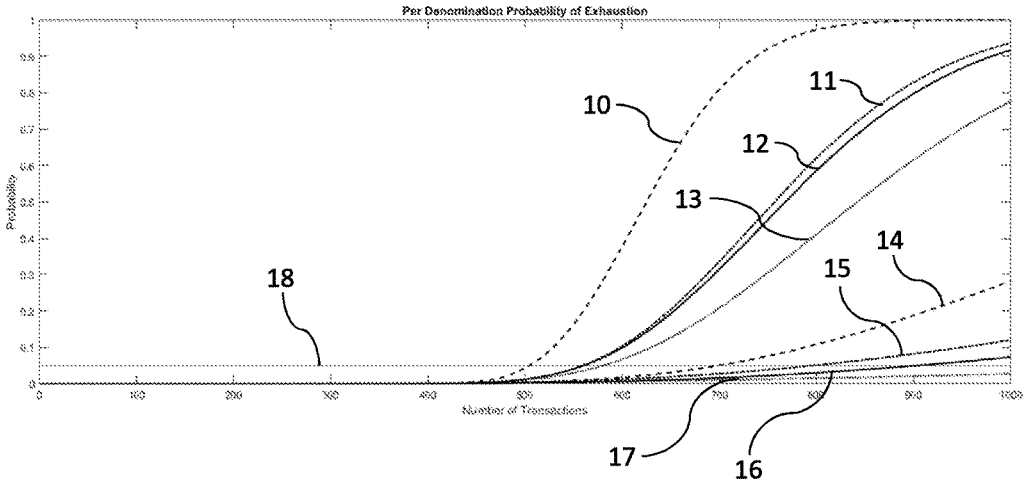
FIG. 3 shows a family of transaction probability distributions.

In the example illustrated by FIG. 3 we have a separate distribution (labelled 10 to 17) for each coin denomination. Line 18 represents a predetermined threshold probability. In the example shown this has been selected to be a probability of 0.05, and this represents a chosen acceptable risk for a coin starvation event. It should be understood that this level can be set at any risk value and this is determined by the operator of the transaction device.

From FIG. 3 it can be seen that as the number of transactions increases the probability of a coin starvation event increases for each denomination. In the example shown line 10 represents the PDF for €0.1 coins, line 11 is the PDF for €0.05 coins, line 12 is the PDF for €1.0 coins, line 13 is the PDF for €0.50 coins, line 14 is the PDF for €2 coins, line 15 is the PDF for €0.02 coins, line 16 is the PDF for €0.01 coins, and line 17 is the PDF for €0.20 coins. It should be understood that this family of PDFs is an example only, each transaction device will have a unique set of PDFs and these may change over time.

It can be seen from line 10 in FIG. 3 that the probability of coin starvation occurring for €0.1 coins, for example, crosses the acceptable threshold probability at around 500 transactions. In contrast, the PDF for €0.10 coins (line 16) does not exceed the threshold until around 900 transactions.

For a particular given denomination i the probability of running out as a function of n is given by:

$$f_i(n) = \int_{-\infty}^{-q_i} \frac{1}{\sigma_i\sqrt{2\pi n}} e^{-\frac{(x-n\mu_i)^2}{(2n^2\sigma_i^2)}} dx \tag{4}$$

Equation (4) can be expressed in terms of an the error function:

$$f_i(n) = \frac{1}{2}\mathrm{erf}\left(\frac{-q_i - n\mu_i}{\sigma_i\sqrt{n} - \sqrt{2}}\right) + \frac{1}{2} \tag{5}$$

From equation (5) a global risk function F(n) for a coin starvation event occurring for any one of the m denominations can be determined and this is given by:

$$F(n) = 1 - \prod_{i=1}^{m} 1 - f_i(n) \tag{6}$$

Figure 4:
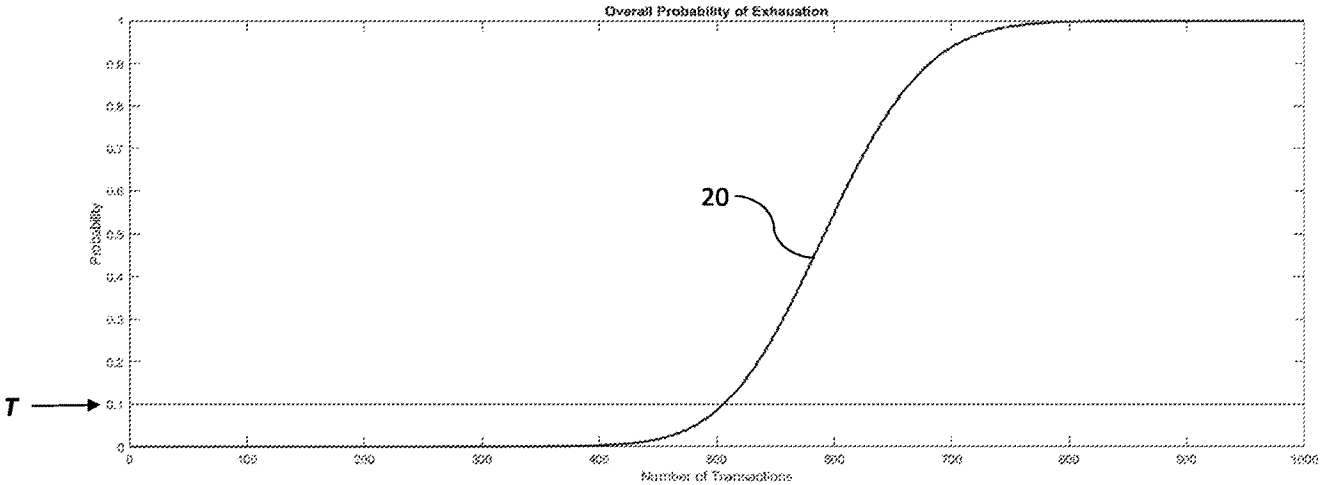
FIG. 4 shows a global transaction probability distribution.

Equation (6) provides a means of predicting the probability of each denomination running out after a certain number of transactions given an initial quantity of coins $q_m$ for each of the m denominations. An example of a global probability function is shown as line 20 in FIG. 4.

If T is the predetermined threshold probability, i.e. the maximum acceptable probability of a coin starvation event irrespective of denomination, then T comprises a set $t_1$, $t_2$, . . . , $t_m$ of maximum acceptable probabilities for a coin starvation event for each denomination. From equation (6) T is defined as:

$$T = 1 - \prod_{i=1}^{m} 1 - t_i \tag{7}$$

Assuming that the probability of a coin starvation event occurring is the same for each denomination, i.e. $t_1 = t_2 = \ldots t_m = t$, then t is defined as:

$$t = \sqrt[m]{1 - T} \tag{8}$$

From equation (6) a value N can be determined, where N is the number of transactions that have occurred before the likelihood of a coin starvation event for any one of the m denominations of coins has reached the probability T.

Optimisation

Conventionally, transaction device operators prefer to maximise the time period between transaction device replenishment operations whilst maintaining a more-or-less constant monetary balance in each of the transaction devices for which they are responsible.

Maximising the time period between replenishments and maintaining a constant monetary balance is equivalent to maximising the number of transactions that have occurred before the probability density function for a particular denomination is equal to t. From this it is possible to define a constant total monetary value Z for a transaction device with a given coin capacity $c_{max}$, where:

$$Z = \sum_{i=1}^{m} v_i q_i \tag{9}$$

$$c_{max} \geq \sum_{i=1}^{m} c_i q_i \tag{10}$$

Here $v_i$ is the monetary value of the ith denomination (€2 for example), and $c_i$ is the number of units of capacity occupied by a coin of the ith denomination. Here, a unit of capacity can be the volume that a single coin (or banknote) occupies or it might be the width of the coin (or banknote). Alternatively, the unit of capacity might be the proportion of the total capacity of the transaction device a single coin occupies or some other suitable metric of capacity.

To determine optimal coin levels for each coin denomination it is necessary to perform a redistribution operation on the number of units of capacity that are allocated to each of the coin denominations. This process follows the steps described below.

Step 1

The number $q_i$ of coins of the denomination having the largest value of $n_i$ at probability t is reduced and the number of coins for the denomination with the lowest value of $n_i$ at probability t is increased by a weighted amount that satisfies the combined requirements of equations (9) and (10). A new value of $n_i$ at probability t is then determined for each denomination and these new values are compared with the median value for $n_i$ from the family of denomination distributions [see FIG. 3]. The process is repeated until one of either of the recalculated values for $n_i$ changes from being more than the value of the median $n_i$ to being less than the value of the median $n_i$, or one of either of the recalculated $n_i$ changes from being less than the value of the median $n_i$ to being more than the value of the median $n_i$. At this point a new value for N is determined and the current value for each $q_i$ is recorded.

Step 2

Step 1 is repeated until the numerical range $n_1$-$n_8$ has become fixed and no substantial change is seen and/or the value of N has reached a static limit and further iterations of Step 2 yield no overall change.

When Step 2 has reached a static conclusion the current values for each $q_1$ to $q_8$ are rounded to the nearest whole number and these values are determined to be the optimum coin replenishment levels for each of the respective eight coin denominations.

From the static value of N a time period can be calculated from which an optimum coin replenishment frequency can be determined. Typically, this will be calculated by determining the average time span between transactions and multiplying this period by N to yield a future time point by when a replenishment operation should take place.

EXAMPLE

FIG. 3 shows a family of distributions for Euro coins. After executing the steps discussed above the following values for q were determined:

$q_1$ (€0.1 coin)=50
$q_2$ (€0.05 coin)=25
$q_3$ (€1.0 coin)=165
$q_4$ (€0.50 coin)=80
$q_5$ (€2.0 coin)=138
$q_6$ (€0.02 coin)=15
$q_7$ (€0.01 coin)=10
$q_8$ (€0.2 coin)=75
N=560 transactions.

For this particular transaction device, the average time between transactions was determined to be approximately 25 minutes. From this it is calculated that the optimum frequency for replenishment operations would be 560 hours, which equates to 10 days when rounded to the nearest whole number of days.

Consequently, the cash float for this particular device is €502.65 made up of the above numbers of coins for each denomination, and the transaction device needs to be replenished with this amount every 10 days until and unless a repeat of the above described calculation steps yields a different float level and/or replenishment frequency. It should be noted that this example is specific to a certain transaction device for a particular transaction observance period, and that for any given transaction device 1, the process of float optimisation is dynamic and is executed repeatedly. The frequency of execution of the optimisation process, and the number of historical transactions that are observed before conducting an optimisation, is determined an implemented by the operator of the transaction device(s).

Typically, the float level and replenishment frequency will be determined by operation of the transaction control means 6 statistics module, and this information will be displayed on the display unit 7 from where the details can be noted by a transaction operative during a routine visit to the transaction device 1.

In some situations, it may be desirable to ensure that the quantity of certain denominations of coins never falls below a predetermined minimum or goes above a predetermined maximum. In this instance if the $q_i$ allocation for a particular denomination in Step 1 or Step 2 becomes too low or too high, then the process switches to the denomination with the next lowest or next highest $n_i$ as appropriate.

Figure 5:
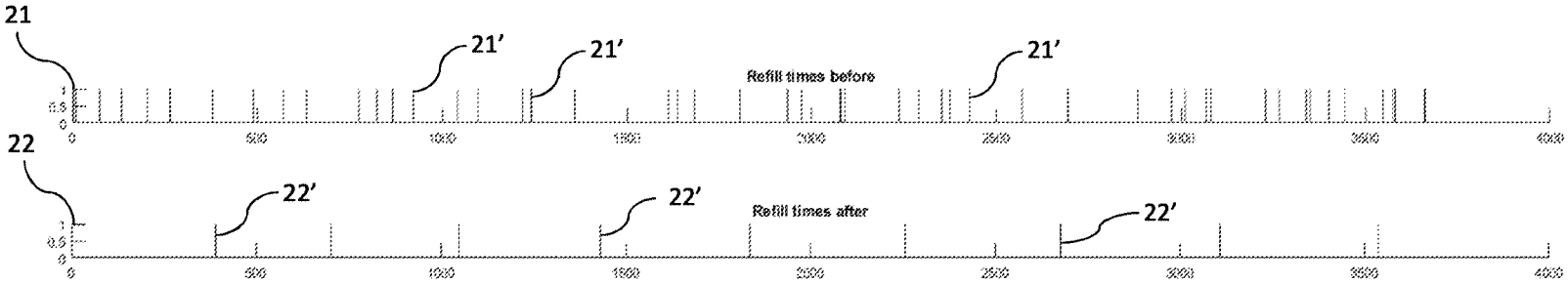
FIG. 5 illustrates the change in the frequency of transaction device refill operations.

FIG. 5 shows the change in the replenishment frequency for a given transaction device subsequent to the execution and implementation of the above described optimisation process.

Graph 21 shows the occurrences 21' of refill operations before optimisation, and graph 22 shows the frequency of refill operations after optimisation. It can be seen from a comparison of the two graphs that the occurrences 22' of refill operations after optimisation has clearly reduced and the period between replenishment operations has become more regular.

Figure 6:
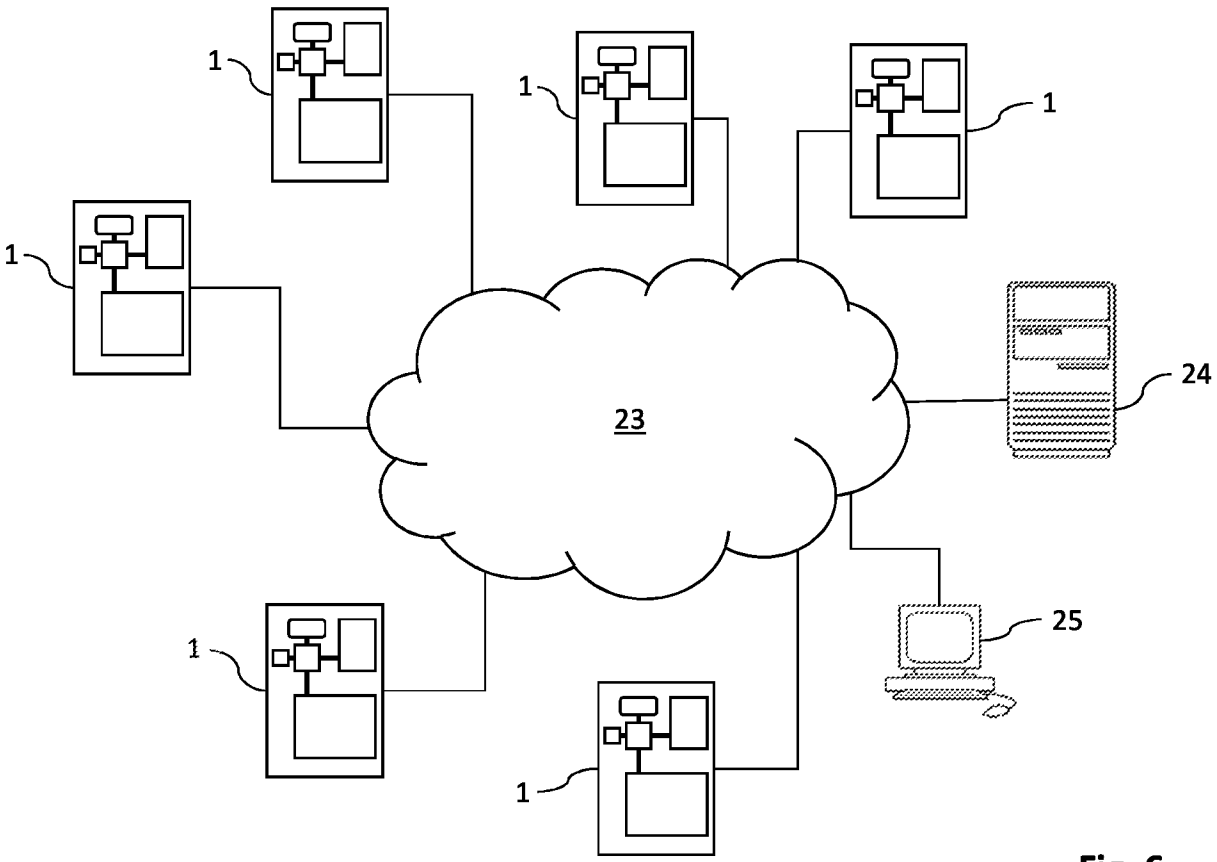
FIG. 6 shows a network of transaction devices.

FIG. 6 illustrates an alternative embodiment of the present invention in which optimisation of float levels for a network of transaction devices is controlled from a central, remote location.

Here, a plurality of transaction devices is connected to a transaction server 24 and/or a central transaction terminal 25 via a network 23. The network 23 may be wired or wireless, but preferably the transaction server 24 and/or the central transaction terminal 25 communicate with the transaction devices 1 over the Internet.

In this embodiment transaction data is collected by the transaction control means 6 from each of the transaction devices 1, and this data is transferred to the transaction server 24. The transaction server 24 includes a statistics module [not shown] which collates and stores the transaction data for each transaction device and performs the statistical analysis and optimisation steps as described above.

The operator of the network of transaction devices can access the results of the statistical and optimisation procedure via a central transaction terminal 25. The central transaction terminal 25 will display to the operator a suitable user interface which details the location and identity of each transaction device 1 in the network, along with the forecast float level (comprising the quantity $q_i$ for each currency item denomination) and the date at which the next replenishment operation should occur. Alternatively, this information is automatically forwarded to the central transaction terminal 25 from the transaction server 24 at suitable periodic intervals.

Advantageously, this enables the operator to plan and schedule a replenishment routine that takes into account the location, replenishment forecast date and requisite float level for each of the transaction devices within the network of devices for which the operator has responsibility.

The invention claimed is:

1. A method of managing currency item replenishment in a transaction device configured to accept a plurality m of currency item denominations, the method comprising analyzing transaction history data to produce at least one statistical distribution from which an optimum currency item replenishment period and currency item replenishment levels are determined, wherein the method comprises:

monitoring a plurality of monetary transactions executed by said transaction apparatus;

determine for each of the plurality of currency item denominations a net payout per transaction distribution over the plurality of monetary transactions;

determine a probability density function for currency exhaustion after n transactions for each of the m currency item denominations;

determine a global risk function for currency exhaustion of at least one of the plurality of currency item denominations after n transactions based on the m probability density functions;

iteratively adjust the probability density function for each of the m currency item denominations by exchanging currency item quantity allocation q between the m currency item denominations until the number of transactions N at which the global risk function equals a predetermined probability T converges to a stationary value; and use the stationary value of N to calculate the optimum currency item replenishment period and set q for which N is stationary to be the optimum currency item replenishment level.

2. A method as claimed in claim 1, wherein q comprises a set of currency item quantity allocations and for i=1 to m, $q=q_1+q_2+\ldots+q_m$.

3. A method as claimed in claim 2, wherein the optimum currency item replenishment period is calculated using the average time elapsed between each of the n transactions.

4. A method as claimed in claim 1, wherein transaction history data is monitored and collected locally by the transaction apparatus.

5. A method as claimed in claim 4, wherein a transaction control means is configured to record transaction history data.

6. A method as claimed in claim 5, wherein the transaction control means includes a statistics module.

7. A method as claimed in claim 1, wherein transaction history data is monitored and collected by a remote processing means via a wired or a wireless network connection.

8. A method as claimed in claim 7, wherein a transaction control means is configured to record transaction history data.

9. A method as claimed in claim 7, wherein the remote processing means includes a statistics module.

10. A method as claimed in claim 1, wherein the transaction device is configured to accept and process coins and/or banknotes.

11. A transaction device configured to accept a plurality m of currency item denominations, wherein said transaction device comprises:

a currency item validator unit including a currency item input/output;

a currency item storage means;

a currency item transport mechanism interconnecting the currency item validator unit and the currency item storage means;

transaction control means connected to the currency item validator unit and the currency item storage means;

wherein the transaction control means includes a statistics module configured to execute statistical analysis of transaction history data; wherein said statistics module is effective for:

i) monitoring a plurality of monetary transactions executed by said transaction apparatus;

ii) determining for each of the plurality of currency item denominations a net payout per transaction distribution over the plurality of monetary transactions;

iii) determining a probability density function for currency exhaustion after n transactions for each of the m currency item denominations;

iv) determining a global risk function for currency exhaustion of at least one of the plurality of currency item denominations after n transactions based on the m probability density functions;

v) iteratively adjusting the probability density function for each of the m currency item denominations by exchanging currency item quantity allocation q between the m currency item denominations until the number of transactions N at which the global risk function equals a predetermined probability T converges to a stationary value; and vi) using the stationary value of N to calculate the optimum currency item replenishment period and set q for which N is stationary to be the optimum currency item replenishment level.

12. A transaction device as claimed in claim 11, wherein the transaction device includes a wired or wireless network interface configured to communicate with a remote processing means.

13. A transaction device as claimed in claim 11, wherein the transaction device is configured to accept and process coins and/or banknotes.

14. A transaction device as claimed in claim 11, wherein said transaction control means is configured to execute a method of managing currency item replenishment in a transaction device configured to accept a plurality m of currency item denominations, the method comprising analyzing transaction history data to produce at least one statistical distribution from which an optimum currency item replenishment period and currency item replenishment levels are determined, wherein the method comprises:

monitoring a plurality of monetary transactions executed by said transaction apparatus;

determine for each of the plurality of currency item denominations a net payout per transaction distribution over the plurality of monetary transactions;

determine a probability density function for currency exhaustion after n transactions for each of the m currency item denominations;

determine a global risk function for currency exhaustion of at least one of the plurality of currency item denominations after n transactions based on the m probability density functions;

iteratively adjust the probability density function for each of the m currency item denominations by exchanging currency item quantity allocation q between the m currency item denominations until the number of transactions N at which the global risk function equals a predetermined probability T converges to a stationary value; and use the stationary value of N to calculate the optimum currency item replenishment period and set q for which N is stationary to be the optimum currency item replenishment level.

15. A transaction device as claimed in claim 11, wherein the remote processing means is configured to execute a method of managing currency item replenishment in a transaction device configured to accept a plurality m of currency item denominations, the method comprising analyzing transaction history data to produce at least one statistical distribution from which an optimum currency item replenishment period and currency item replenishment levels are determined, wherein the method comprises:

monitoring a plurality of monetary transactions executed by said transaction apparatus;

determine for each of the plurality of currency item denominations a net payout per transaction distribution over the plurality of monetary transactions;

determine a probability density function for currency exhaustion after n transactions for each of the m currency item denominations;

determine a global risk function for currency exhaustion of at least one of the plurality of currency item denominations after n transactions based on the m probability density functions;

iteratively adjust the probability density function for each of the m currency item denominations by exchanging currency item quantity allocation q between the m currency item denominations until the number of transactions N at which the global risk function equals a predetermined probability T converges to a stationary value; and use the stationary value of N to calculate the optimum currency item replenishment period and set q for which N is stationary to be the optimum currency item replenishment level;

wherein transaction history data is monitored and collected by a remote processing means via a wired or a wireless network connection.

* * * * *